United States Patent [19]

Groya et al.

[11] 4,133,357

[45] Jan. 9, 1979

[54] HAND TOOL REST FOR FORMING CURVED SURFACES

[75] Inventors: George J. Groya, St. Louis County; Curtis J. Eccardt, St. Charles, both of Mo.

[73] Assignee: Emerson Electric Co., St. Louis, Mo.

[21] Appl. No.: 816,004

[22] Filed: Jul. 15, 1977

[51] Int. Cl.[2] ..... B27C 7/06

[52] U.S. Cl. ..... 142/49; 142/1; 144/33

[58] Field of Search ..... 142/48, 49, 21, 38, 142/43, 44, 1; 144/33; 408/241 S

[56] References Cited

U.S. PATENT DOCUMENTS

| | | | |
|---|---|---|---|
| 7,523 | 7/1850 | Everett | 144/33 |
| 684,508 | 10/1901 | Grant | 142/49 |
| 1,343,319 | 6/1920 | Herzo | 142/1 |
| 1,487,538 | 3/1924 | Chadek | 142/38 |
| 2,068,625 | 1/1937 | Burton | 142/38 |
| 3,301,101 | 1/1967 | McEwen | 408/241 S |

*Primary Examiner*—Leonidas Vlachos
*Attorney, Agent, or Firm*—Charles E. Markham

[57] ABSTRACT

A rest for a hand held wood turning tool which facilitates the forming of concave and convex surfaces has a horizontal rest bar comprising two joined and oppositely curving arcuate portions of different curvature in the general form of a letter "S," with a bevelled tool rest surface extending continuously along one side thereof and an intermediately positioned downwardly extending cylindrical mounting post. A simplified modification has a single horizontal arcuate rest bar with bevelled tool rest surfaces extending along both sides.

8 Claims, 10 Drawing Figures

6
50
34
48
28
36
5
30
6
50
48
38
32
5

54
56

62
64
60
58

48
30
50
38
44
42
40

48
30

48
30

10
14
52

24
20
15
12
18
16
19

34
20
48
18
28

28

48
32

10
14
12
15
25
24

46
20
26
18
16

HAND TOOL REST FOR FORMING CURVED SURFACES

This invention relates generally to tool rests for hand held wood turning tools and particularly to a rest which facilitates the turning of curved surfaces.

When forming concave or convex surfaces on a wood lathe with a hand held cutting tool and a conventional tool rest having a straight tool rest surface, it is necessary to frequently adjust the rest in order to maintain it close enough to the workpiece to provide the necessary rigid support for the tool as it is moved along the curved surface. It is particularly important when forming curved surfaces of relatively large radii, such as the forming of the convex and concave surfaces of a wood bowl on the face plate of a lathe, to minimize the overhang of the cutting tool edge from the rest in order to prevent chattering and produce a smooth surface.

Accordingly, it is an object of this invention to provide a rest for hand held cutting tools having an arcuate tool rest surface.

A further object of the invention is to provide a rest for hand held cutting tools having a horizontal tool rest surface extending through two oppositely curving arcuate surfaces of different curvature.

A further object is to provide a rest for hand held cutting tools having a horizontal tool rest bar extending through two oppositely curving arcuate surfaces and having a bevelled tool rest surface extending throughout along one side of the rest bar.

Other objects and advantages will appear from the following description when read in connection with the accompanying drawing.

Figure 1:
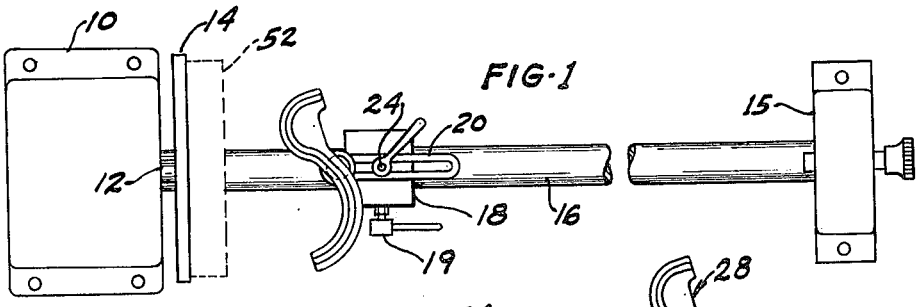
FIG. 1 is a top plan view of a wood lathe having mounted thereon a tool rest constructed in accordance with the invention.
Figure 2:
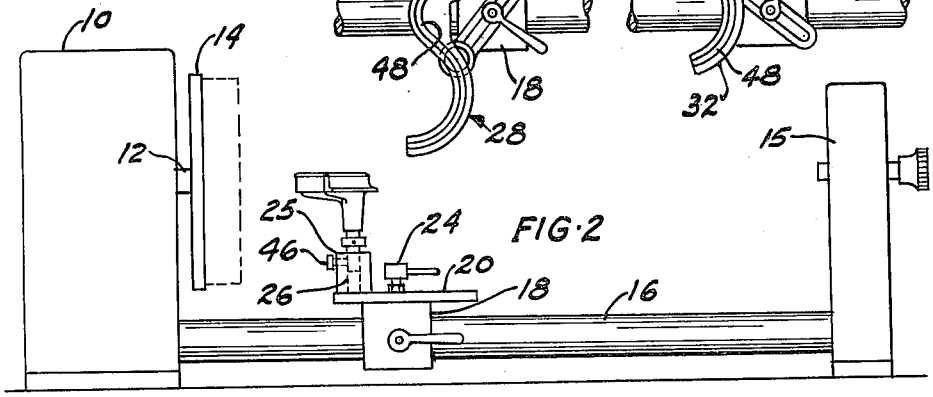
FIG. 2 is a side elevational view of the lathe and tool rest shown in FIG. 1.

Referring to FIGS. 1 and 2 of the drawings, a wood lathe has a head stock 10 including a driven spindle 12 and a face plate 14 rigidly connected to a tail stock 15 of a single rigid bar 16 forming the lathe ways. Slidably mounted on the bar 16 is a carriage 18 which is releasably locked in position by screw-threaded means 19. Mounted in the upper surface of carriage 18 for rotative and translational adjustment with respect to the slidable carriage is a horizontal tool rest holder 20. Rest holder 20 has an elongated, horizontal, slotted portion 22 and is releasably clamped in an adjusted position to carriage 18 by screw-threaded means 24 which extends through the slotted portion 22 and forms a pivot for rotative adjustment of the rest holder. The rest holder 20 further includes an integral upstanding post 25 at one end of elongated portion 22. The post 25 has a vertical bore 26 therein.

Figure 3:
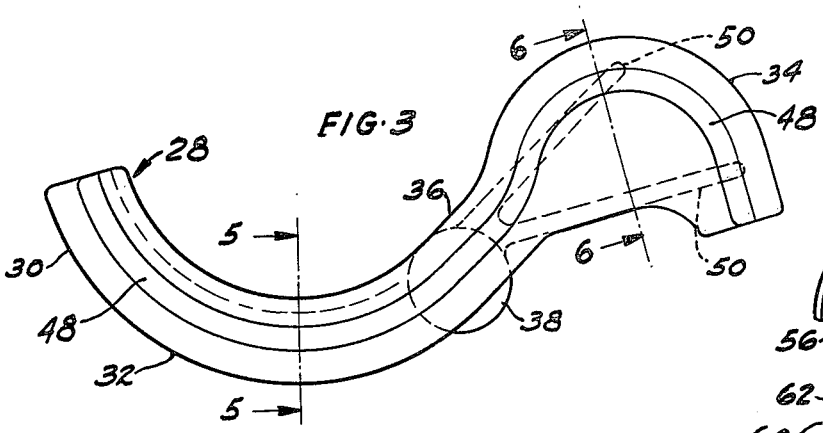
FIG. 3 is an enlarged plan view of the tool rest shown in FIGS. 1 and 2.
Figure 4:
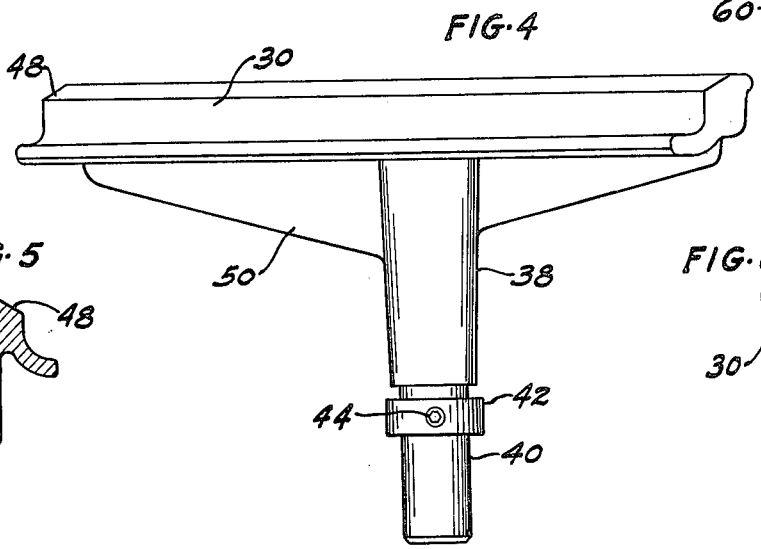
FIG. 4 is an enlarged elevational view of the tool rest shown in FIGS. 1 and 2.
Figure 5:
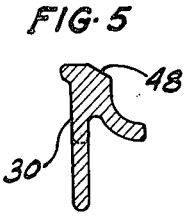
FIG. 5 is a cross sectional view taken along line 5—5 of FIG. 3.
Figure 6:
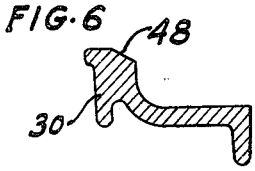
FIG. 6 is a cross-sectional view taken along line 6—6 of FIG. 3.

A tool rest generally indicated at 28 and shown enlarged in FIGS. 3 and 4 has an elongated horizontal rest bar 30 comprising a larger radius arcuate portion 32 and an oppositely curving small radius arcuate portion 34 joined thereto by a short straight portion 36. Intermediately of the two curved portions is a downwardly extending mounting post 38 having at least a lower portion 40 thereof of cylindrical form. Slidable on the cylindrical portion of post 38 is a collar 42 held in a vertically adjusted position by a set screw 44.

The lower cylindrical portion 40 of post 38 is entered into the vertical bore 26 of rest 20 and its entry therein is limited by the adjustable collar 42. The tool rest 28 is therefore rotatably and vertically adjustable in bore 26 with respect to rest holder 20, the rest holder 20 being rotatably and horizontally adjustable with respect to carriage 18 and carriage 18 being slidably adjustable toward or away from the face plate 14.

A portion of the upper surface of rest bar 30 is bevelled along one side thereof at 48, preferably at about 30 degrees to the horizontal, to form an inclined tool rest surface which extends along the same side of the rest bar throughout both larger and smaller reversely curving arcuate portions 32 and 34. The horizontal rest bar and mounting post 38 is preferably cast with integral stiffening ribs 50 to provide increased rigidity.

IN OPERATION

Figure 7:
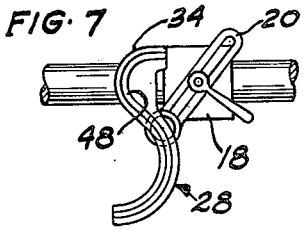
FIG. 7 is a partial plan view showing the tool rest positioned for turning a concave surface on a workpiece mounted on the face plate of the lathe shown in FIGS. 1 and 2.
Figure 8:
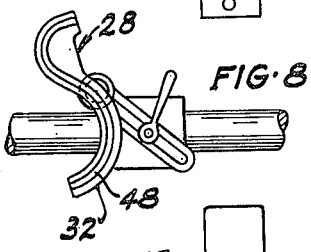
FIG. 8 is a partial plan view showing the tool rest positioned for turning a convex surface on a workpiece mounted on the face plate of the lathe shown in FIGS. 1 and 2.

When it is desired, for example, to turn the inner concave surface of a bowl from a workpiece 52 mounted on the face plate of the lathe, the rest 28 is positioned as shown in FIG. 7, with the smaller arcuate rest portion 34 positioned so that it can be moved axially inward as the concave turned surface is developed so as to maintain a minimum overhang of the cutting tool from the seat. In this position the bevelled tool rest surface 48 is on the concave side of the rest bar 30. When, subsequently, the outer convex surface of the bowl is to be turned, the tool rest 28 is positioned as shown in FIG. 8. When in this position the rest may again be moved axially toward the workpiece as the convex surface is developed so as to maintain a minimum overhang of the cutting tool from the rest. In this position, the bevelled tool rest surface 48 is on the convex side of the rest bar.

It is to be understood that while the spacing of the two oppositely curving arcuate surfaces 32 and 34 by the straight connection section 36 is desirable in that it provides more free space to swing a hand held tool as it is moved along an arcuate surface, it is not essential to the successful operation of the tool rest. Also, while the tool rest 28 with its two oppositely curving surfaces of different radii is admirably suited to turning wood bowls on the face plate of a lathe, it may also be employed effectively in turning any concave or convex surface on a workpiece either mounted on the lathe face plate or held between the head stock and tail stock.

MODIFICATION OF FIGS. 9 AND 10

Figure 9:
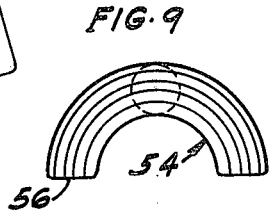
FIGS. 9 and 10 are top plan and side elevational views, respectively, of a simplified form of the invention which has but one reversible arcuate surface.
Figure 10:
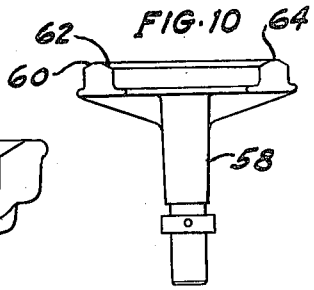

A simplified form of an arcuate tool rest, generally indicated at 54, which facilitates turning convex or concave surfaces with a hand held cutting tool is shown in FIGS. 9 and 10. Rest 54 comprises an arcuate horizontal rest bar 56 and an intermediately positioned downwardly extending mounting post 58 similar to the mounting post 38 of tool rest 28. The horizontal arcuate rest bar 56 has two bevelled tool rest surfaces 60 and 62 extending throughout the length of the bar, one on each side of an intermediate surface 64. A bevelled tool rest surface is thus provided on the concave surface of the rest when positioned so as to turn a concave surface on a workpiece and on the convex surface of the rest when it is rotated 180 degrees to turn a convex surface on a workpiece.

It is to be understood that the primary purpose of the invention is to provide a tool rest which will substantially reduce the frequent rest adjustment necessary when employing a conventional straight hand tool rest in turning curved surfaces so as to maintain the tool rest close enough to the workpiece as the curved surface is being formed thereon. The curved or arcuate surfaces of tool rests 28 and 54 may be segments of a true circle, although they need not be to be effective in substantially reducing the frequency of tool seat adjustment. Also, the curvature of the surfaces of tool rests 28 and 54 may closely coincide with a curved surface to be turned, although they need not to be effective in substantially reducing frequency of tool rest adjustment over that required when employing a conventional straight hand tool rest.

We claim:

1. In a hand tool rest to facilitate the turning of curved surfaces on a wood lathe, a horizontal tool rest bar comprising two joined oppositely curving arcuate portions and a cylindrical mounting post positioned between said arcuate portions and extending downward from said rest bar, tool rest mounting means including a carriage slidably adjustable along the ways of a lathe and a tool rest holder mounted for horizontal rotation and translational adjustment on said carriage, said rest holder including a vertical bore therein receiving said mounting post for vertical sliding movement and rotation therein, and releasable means on said rest holder for locking said post in a predetermined vertical and rotative position in said bore.

2. The tool rest claimed in claim 1 in which said horizontal rest bar includes an intermediate straight portion between said oppositely curving portions.

3. In a hand tool rest to facilitate the turning of curved surfaces on a wood lathe, a horizontal tool rest bar comprising two joined oppositely curving arcuate portions of different curvature and an intermediately positioned mounting post positioned between said arcuate portions and extending vertically downward from said rest bar, support means having a vertical bore therein receiving said mounting post for vertical and rotational movement therein, and releasable means on said support means for locking said post in a predetermined vertical and rotative position in said bore.

4. The tool rest claimed in claim 3 in which said horizontal rest bar includes a straight portion connecting said two oppositely curving arcuate portions.

5. The tool rest claimed in claim 4 in which said horizontal rest bar is provided with an inclined tool rest surface extending along the convex side of one arcuate portion and along the concave side of the other arcuate portion.

6. The tool rest claimed in claim 5 in which said horizontal rest bar is provided with an inclined tool rest surface extending continuously along one side thereof.

7. A hand tool rest to facilitate the turning of wood bowls on a wood lathe, comprising a horizontal tool rest bar comprising two oppositely curving arcuate portions joined by a straight portion, one of said arcuate portions having a greater radius than the other, and an intermediately positioned mounting post extending vertically downward from said straight portion of said rest bar adapted to be entered into the vertical bore of a rest holder.

8. The tool rest claimed in claim 7 having an inclined tool rest surface extending continuously along the convex side of said one arcuate portion, along said straight portion, and along the concave side of said other arcuate portion.

* * * * *